US012329239B2

(12) United States Patent
Santos

(10) Patent No.: US 12,329,239 B2
(45) **Date of Patent: *Jun. 17, 2025**

(54) INTERCHANGEABLE FOREPARTS FOR SHOES

(71) Applicant: Columbia Insurance Company, Omaha, NE (US)

(72) Inventor: Kenneth Daniel Santos, Randolph, MA (US)

(73) Assignee: Columbia Insurance Company, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/989,967

(22) Filed: Aug. 11, 2020

(65) Prior Publication Data

US 2021/0000212 A1 Jan. 7, 2021

Related U.S. Application Data

(63) Continuation of application No. 13/892,556, filed on May 13, 2013, now Pat. No. 10,772,375, which is a continuation of application No. 12/271,396, filed on Nov. 14, 2008, now Pat. No. 8,458,927.

(51) Int. Cl.

| | |
|---|---|
| ***A43B 3/24*** | (2006.01) |
| ***A43B 1/00*** | (2006.01) |
| ***A43B 5/00*** | (2022.01) |
| ***A43B 13/36*** | (2006.01) |

(52) U.S. Cl.

CPC ..... *A43B 3/24* (2013.01); *A43B 1/0081* (2013.01); *A43B 3/246* (2013.01); *A43B 5/005* (2013.01); *A43B 5/008* (2013.01); *A43B 13/36* (2013.01)

(58) Field of Classification Search

CPC ..... A43B 1/0081; A43B 3/24; A43B 3/246; A43B 5/008; A43B 13/36

USPC ..... 36/15, 72 R, 100, 101, 130

See application file for complete search history.

(56) References Cited

U.S. PATENT DOCUMENTS

| | | | | | |
|---|---|---|---|---|---|
| 2,640,283 | A * | 6/1953 | McCord | A43B 5/00 | 36/25 R |
| 3,526,976 | A * | 9/1970 | Jacobs | A43C 15/162 | 36/100 |
| 4,301,604 | A * | 11/1981 | Hamilton | A43B 5/18 | 36/130 |
| 6,243,973 | B1 * | 6/2001 | Lind | A43B 13/26 | 36/100 |
| 6,907,682 | B2 * | 6/2005 | Alfond | A43C 15/04 | 36/15 |
| 7,559,159 | B1 * | 7/2009 | Lundberg | A43B 3/163 | 36/7.1 R |
| 2003/0159314 | A1 * | 8/2003 | Lewia | A43B 13/36 | 36/15 |
| 2007/0107258 | A1 * | 5/2007 | Umezawa | A43B 5/00 | 36/28 |

(Continued)

*Primary Examiner* — Sharon M Prange

(74) *Attorney, Agent, or Firm* — IP Attorneys Group, LLC

(57) ABSTRACT

The invention relates to a footwear kit and method of providing a footwear kit comprising a forepart that can be removably attached to both a left shoe and a right shoe, in which the shoes are substantially asymmetric about a line running from the front to the back of the shoe, and in which the periphery of the forepart substantially matches the periphery of the toe region of both the left shoe and the right shoe.

20 Claims, 3 Drawing Sheets

(56) References Cited

U.S. PATENT DOCUMENTS

| | | | | |
|---|---|---|---|---|
| 2007/0163148 | A1* | 7/2007 | Laporte | A43C 15/08<br>36/61 |
| 2008/0216353 | A1* | 9/2008 | Langvin | A43B 13/189<br>36/93 |

* cited by examiner

INTERCHANGEABLE FOREPARTS FOR SHOES

CROSS REFERENCE TO RELATED APPLICATION

This application is a continuation application of U.S. Non-Provisional patent application Ser. No. 13/892,556, filed May 13, 2013 and titled "Shoe with Interchangeable Foreparts and Heels," which is a continuation application of U.S. Non-Provisional patent application Ser. No. 12/271,396 filed Nov. 14, 2008 and titled "Shoe with Interchangeable Foreparts and Heels." The contents of the above-identified Applications are relied upon and incorporated herein by reference in their entirety.

FIELD OF THE INVENTION

The present invention generally relates to shoes for bowling, and more particularly, to bowling shoes having interchangeable foreparts and heels, where each forepart and each heel can be applied to either the left or right shoe, depending upon the wearer's preference.

BACKGROUND OF THE INVENTION

Bowling shoes are often provided with different shoe soles for varying traction of the shoe sole on a surface of a bowling lane. In specific bowling lane conditions, the stopping and the sliding characteristics of a shoe can greatly enhance an ability of a bowler to stop his feet suddenly and abruptly. For example, when the bowler approaches a foul line to throw a ball, one foot usually performs the slide action and the other foot performs the traction action. A slide shoe for the slide action usually has a sole made with a low friction material, and a traction shoe has a sole with a high friction material for better traction. However, a specific design of the bowling shoe will greatly depend on each bowler's individual style and preference, on bowling surface conditions, and on whether the bowler is right- or left-handed.

One of the problems associated with conventional bowling shoes having fixed shoe soles is that a bowler must purchase many pairs of bowling shoes to adjust to various bowling surface conditions. Additionally, the ball and heel portions of the shoe often become worn out due to increased stress exerted on these portions, thus rendering the whole shoe unusable to the bowler. Furthermore, the shoes are usually designed to fit either a left-handed or right-handed bowler, but not both. Thus, although there is a relatively small number of left-handed bowlers, manufacturers must maintain a sufficient inventory for both left- and right-handed bowlers, which leads to an increased cost of the bowling shoes.

To solve these problems, the bowling shoes are often provided with removable pads attached to the underside of the shoe sole to allow the bowler to adjust the friction of the shoe. For example, U.S. Pat. No. 7,246,453 to Kim, U.S. Pat. No. 6,598,324 to Tsuji, and U.S. Pat. No. 5,542,198 to Famolare describe bowling shoes with interchangeable foreparts and interchangeable heels on the same shoe, but not on either shoe. For such shoes, inventory must include a set of replaceable parts specifically adapted for attachment to the right shoe and a set of replaceable parts adapted for attachment to the left shoe. Also, different sets of replaceable parts must be provided based on whether the shoes are designed for use by right- or left-handed bowlers.

Other known bowling shoes include the shoes that have interchangeable inserts that may be attached to either a left or right shoe outsole. For example, U.S. Pat. No. 3,672,077, issued to Coles, discloses a shoe which has removable cleats or inserts attached to a plurality of spaced recesses in the shoe sole. The user may selectively replace individual inserts that have different coefficients of friction to achieve desired degrees of traction on the bowling surface. U.S. Pat. No. 6,662,476 to Lind, U.S. Pat. No. 6,651,360 to Lind, and U.S. Pat. No. 6,243,973 to Lind all appear to relate to a pad that is interchangeable with another pad, where each pad is removably attached to either the left or right shoe. In addition, each pad is different than the next pad. However, the pads or inserts provided in the above-cited patents seem to be limited to a section of the overall bottom surface of the shoe, as opposed to covering the entire bottom surface. This limited size relative to the overall bottom surface may be important in permitting the pad to be attached to either the left or right shoe. Additionally, when the pads or inserts cover only a portion of the overall bottom surface of the shoe sole, the peripheral shoe sole material makes contact with the bowling surface, which negatively affects the movement of the bowler.

SUMMARY OF THE INVENTION

Accordingly, it is an object of the present invention to provide bowling footwear that has removable foreparts and heel parts made out of various sliding materials to enable a bowler to improve sliding on varying bowling lane surface conditions.

It is a further object of the present invention to provide the bowling footwear with improved removable foreparts that cover the entire lateral bottom surface of the shoe sole.

It is yet a further object of the present invention to provide bowling footwear having interchangeable foreparts and heel parts that can be applied to either the left or right shoe.

These and other objects are achieved according to a first embodiment of the present invention by provision of a bowling footwear kit having a left shoe and a right shoe, each shoe including a midsole with a toe region and a heel region, wherein the toe region includes the entire area from the front of the shoe to a selected line in front of the heel region, and the peripheral shapes of the toe region of the left shoe and of the toe region of the right shoe are substantially identical. The kit further includes a forepart which functions as an outsole for either the toe region of the right shoe or the toe region of the left shoe. The forepart has a peripheral shape that substantially matches the peripheral shape of the toe regions of both the left shoe and the right shoe, such that the forepart may be mounted to the left shoe and to the right shoe.

In some embodiments, the toe regions of the left and right shoes extend from about one half to about three fourths of the distance between the front of the shoe and the back of the shoe. In some embodiments, the toe regions of the left and right shoes extend from about five eighths to about seven eighths of the distance between the front of the shoe and the back of the shoe. In some embodiments, the toe regions of the left and right shoes extend from about three eighths to about five eighths of the distance between the front of the shoe and the back of the shoe. In some embodiments, the forepart removably attaches to the toe regions of the left and right shoes using a hook and loop fastening system.

According to a second embodiment, a bowling footwear kit is provided having a left shoe and a right shoe, each shoe including a midsole with a toe region and a heel region, wherein the toe region includes the entire area from the front of the shoe to a selected line in front of the heel region, and the peripheral shapes of the toe region of the left shoe and of the toe region of the right shoe are substantially identical. The bowling footwear kit further includes a first forepart having a first traction characteristic for removably attaching to the toe region of the midsole of either the left or right shoe, and a second forepart having a second traction characteristic different from the first traction characteristic for removably attaching to the toe region of the midsole of either the left or right shoe. The peripheral shape of the first forepart and the peripheral shape of the second forepart are substantially identical to each other and substantially identical to the peripheral shape of the toe regions of the left and right shoes. The first forepart may be removably attached to the toe region on the left shoe and also may be removably attached to the toe region on the right shoe, and the second forepart also may be removably attached to the toe region on the left shoe and also may be removably attached to the toe region on the right shoe. In certain embodiments, the toe regions of the left and right shoes extend from about five eighths to about seven eighths of the distance between the front of the shoe and the back of the shoe. In certain embodiments, the toe regions of the left and right shoes extend from about one half to about three fourths of the distance between the front of the shoe and the back of the shoe. In certain embodiments, the toe regions of the left and right shoes extend from about three eighths to about five eighths of the distance between the front of the shoe and the back of the shoe.

In some embodiments, the bowling footwear kit further includes a third forepart having a third traction characteristic and a fourth forepart having a fourth traction characteristic, wherein the third and fourth traction characteristics are different from each other and from the first and second traction characteristics, and wherein the third and fourth foreparts are interchangeable with the first and second foreparts.

In some embodiments, the shapes of the heel region of the left shoe and the heel region of the right shoe are substantially identical, and the kit further includes a first heel part for removably attaching to the heel region of the left or right shoe, and a second heel part for removably attaching to the heel region of the left or right shoe, wherein the first heel part may be removably attached to the heel region on the left shoe and also may be removably attached to the heel region on the right shoe, and the second heel part also may be removably attached to the heel region on the left shoe and also may be removably attached to the heel region on the right shoe.

In some embodiments, the first and second foreparts removably attach to the toe regions of the left and right shoes using a hook and loop fastening system. In some embodiments, the first and second heel parts removably attach to the heel regions of the left and right shoes using a hook and loop fastening system.

According to a third exemplary embodiment of the present invention, a forepart for a shoe, which functions as an outsole for the toe region of the shoe, is provided. The forepart has a bottom surface for contact with the ground, and a mounting surface for contact with and mounting to a toe region of a shoe. The forepart has a peripheral shape that substantially matches the peripheral shape of the toe regions of both a left shoe and a right shoe, such that the forepart may be mounted to the left shoe and to the right shoe.

In some embodiments, when the forepart is mounted to either the left or the right shoe, the forepart covers the entire toe region of the shoe, the toe region having the area from about five eighths to about seven eighths of the distance between the front of the shoe and the back of the shoe. In certain embodiments, the toe region has the area from about one half to about three fourths of the distance between the front of the shoe and the back of the shoe. In certain embodiments, the toe region comprises the area from about three eighths to about five eighths of the distance between the front of the shoe and the back of the shoe.

In some embodiments, the mounting surface includes a first part of a two-part fastener for attaching to the second part of the two-part fastener which is disposed on the toe region of the left and right shoes.

The particular details and benefits of the present invention will be apparent to those of skill in the art based on the following description with reference to the appended drawings.

DETAILED DESCRIPTION OF THE INVENTION

Referring now to the figures in which identical elements are numbered identically throughout, a description of exemplary embodiments of the present invention will now be provided.

Figure 1:
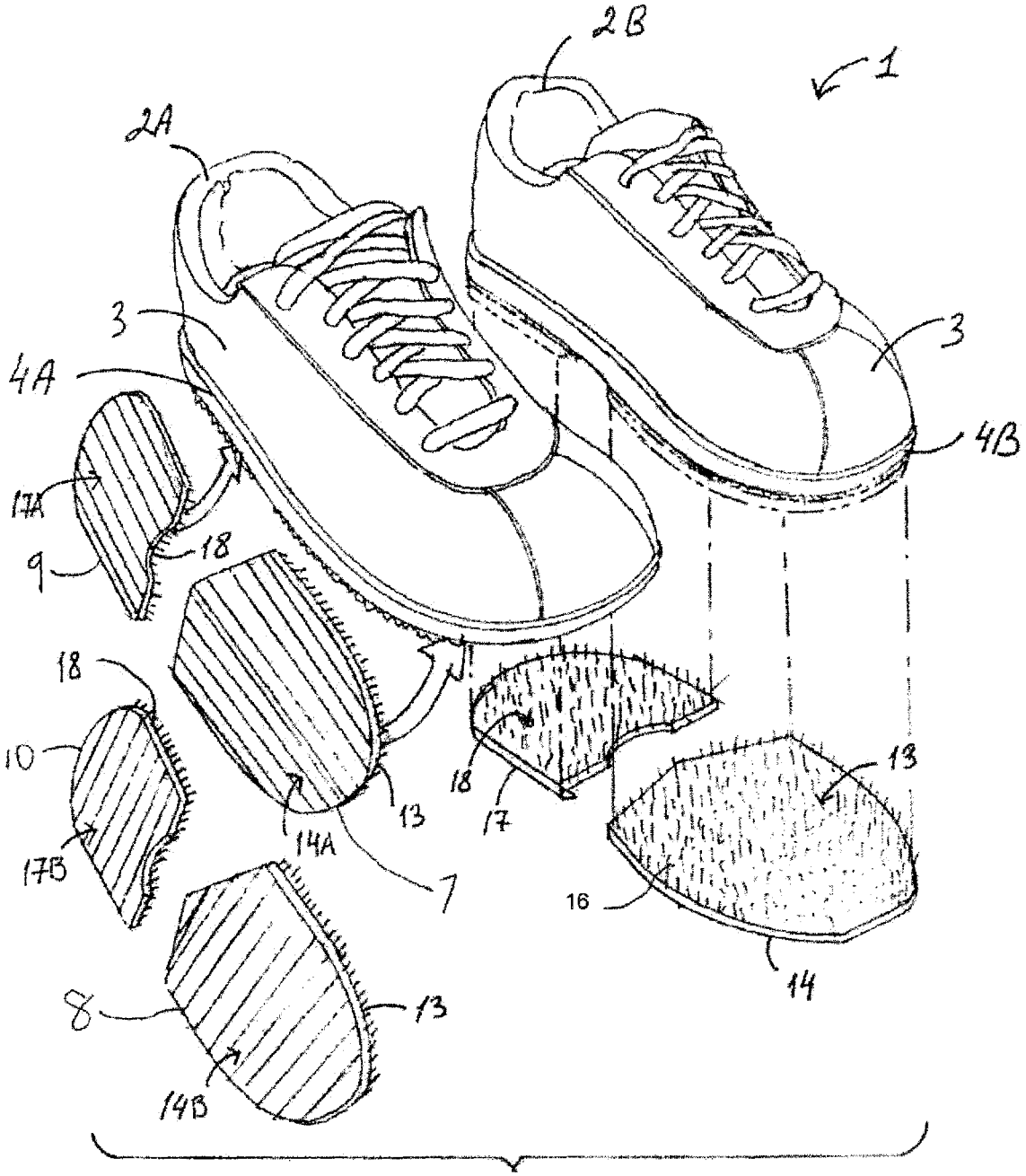
FIG. 1 is a perspective view of a pair of bowling shoes, a pair of foreparts and a pair of heels comprising a bowling footwear kit.

Referring now to FIG. 1, a bowling footwear kit 1 includes a right shoe 2A and a left shoe 2B. Each shoe comprises a shoe upper 3 that is conventional in construction, and is preferably constructed from leather materials. However, it should be understood that any other suitable material may be used for the shoe upper in accordance with the present invention. Each shoe also has a midsole (4A and 4B respectively) preferably constructed from ethylene vinyl acetate (EVA), although other conventional shoe sole materials are also suitable.

Figures 3A, 3B:
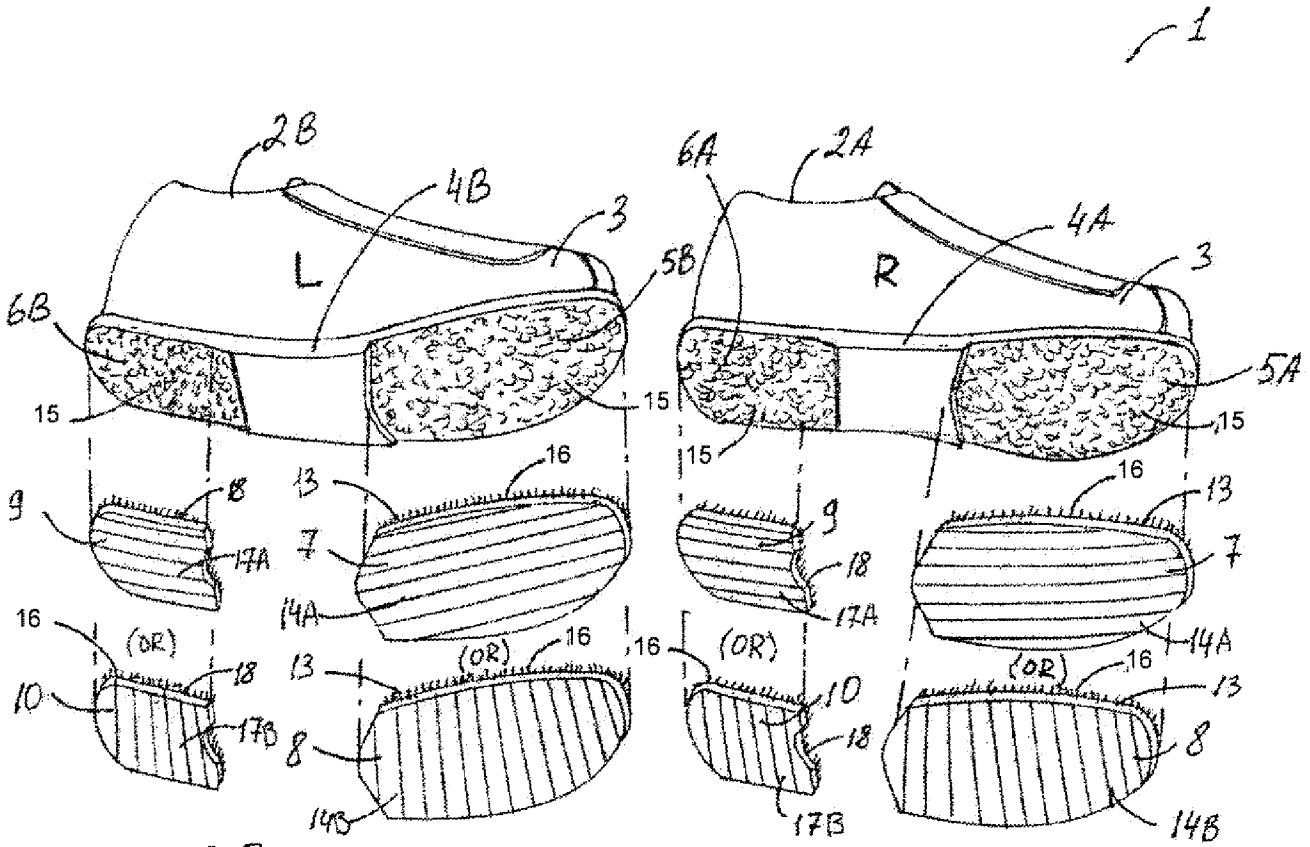
FIG. 3A is a perspective view of the right shoe, with removable foreparts and heel parts in position to be attached, and showing a hook and loop fastening system for attachment.
FIG. 3B is a perspective view of the left shoe, with removable foreparts and heel parts in position to be attached, and showing a hook and loop fastening system for attachment.

FIGS. 3A and 3B show that the midsoles 4A and 4B each have a toe region 5A and 5B respectively and a heel region 6A and 6B respectively. The toe regions 5A and 5B are sized to include the entire area from the front of each shoe 2A and 2B to a selected line in front of the heel region 6A and 6B of each shoe. The toe regions 5A and 5B are designed to receive outsole foreparts which are removably attachable, as described below. The size of the toe region may vary according to the desired level of traction and sliding. According to the embodiment shown in FIGS. 3A and 3B, the toe regions 5A and 5B of the left shoe 2B and the right shoe 2A extend to about three eighths of the distance between the front and the back of each shoe. In other embodiments, the toe regions 5A and 5B may extend from about one half to about three fourths of the distance between the front of the shoe and the back of each shoe. In yet other embodiments of the present invention, the toe regions 5A and 5B may also extend from about five eighths to about seven eighths of the distance between the front of the shoe and the back of each shoe 2A and 2B.

As shown in FIG. 1, the bowling footwear kit further includes a first forepart 7 and a second forepart 8 which function as outsoles for the toe regions 5A and 5B of the right shoe 2A and the left shoe 2B respectively. Each forepart is made out of a sheet of flexible material having a predetermined traction characteristic. The term "traction characteristic" encompasses any quality of the forepart that affects the amount of traction between the shoe and the surface on which it is placed. Traction refers to the adhesive friction between the shoe outsole and the surface upon which it is placed. A first example of a traction characteristic of a forepart that can be varied is the coefficient of static and/or kinetic friction associated with the material used to form the forepart. Thus, traction characteristics may be varied by using materials having a high coefficient of friction, such as rubber or the like, or a low coefficient of friction, such as leather or the like. A second example of a traction characteristic of a forepart that can be varied is the design of the tread of the forepart for contacting the floor surface. The traction characteristic can be adjusted by varying the surface area of the forepart that comes into contact with the floor surface, or by adjusting the shapes of the regions of the forepart that contact the floor surface. For example, grooves or ridges may be formed on the tread of the forepart to provide for a desired amount of traction.

Figure 2:
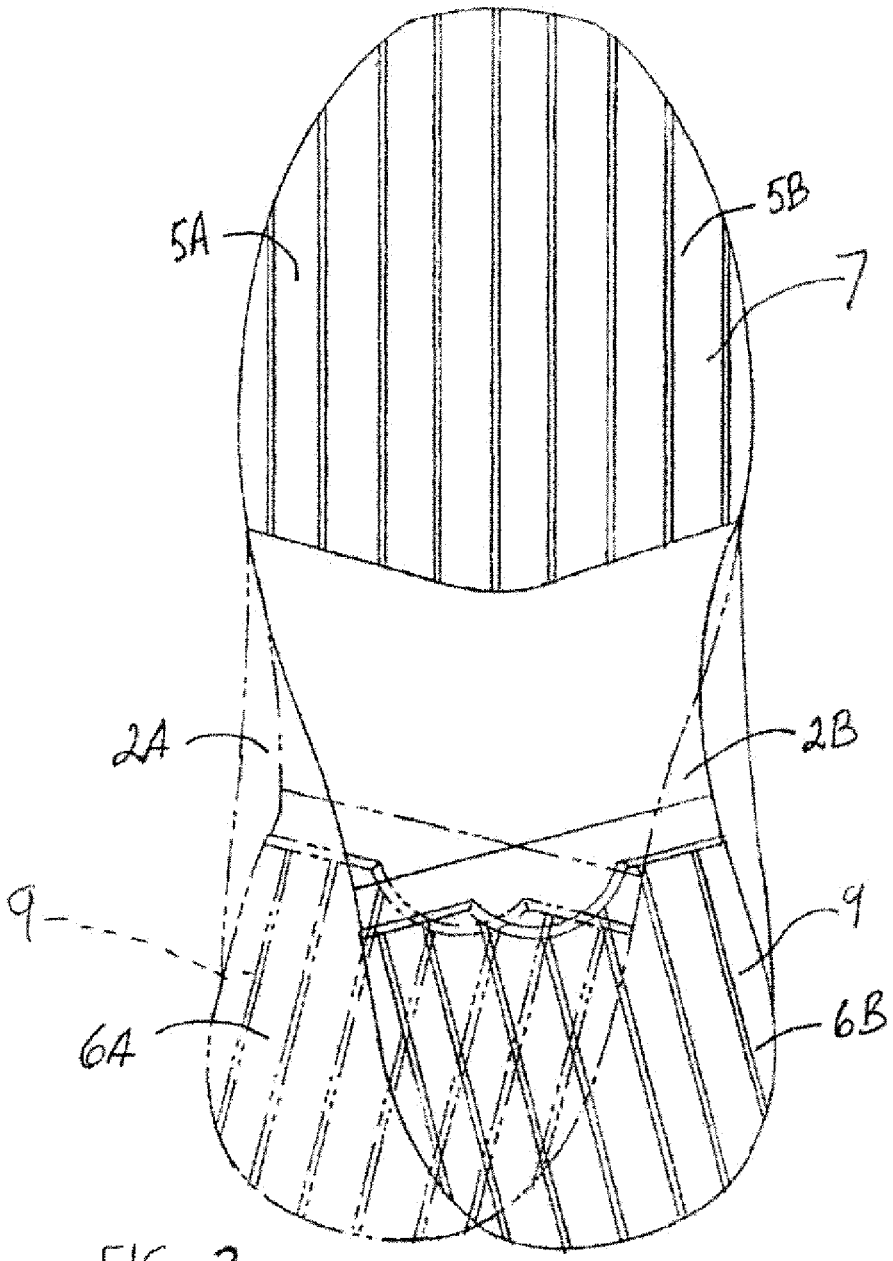
FIG. 2 is a bottom view of the left and right shoe of the bowling footwear kit juxtaposed on top of each other.

Each forepart has a bottom surface 14 for contact with the ground and a mounting surface 13 for contact with and mounting to the toe regions 5A and 5B. As shown in FIG. 1, the traction characteristic of bottom surface 14A is different than that of bottom surface 14B. This is designated by different orientations of the lines drawn on each surface in FIG. 1. Each forepart further has a peripheral shape that substantially matches the peripheral shape of the toe regions 5A and 5B of both the right shoe 2A and the left shoe 2B, such that each forepart may be mounted to the left shoe 2B and to the right shoe 2A. Specifically, the peripheral shape of the first forepart 7 and the peripheral shape of the second forepart 8 are substantially identical to each other, as shown in FIGS. 1 and 2, and substantially identical to the peripheral shape of the toe regions 5B and 5A of the left shoe 2B and right shoe 2A, as illustrated in FIG. 3. Thus, the first forepart 7 may be removably attached to the toe region 5A of the right shoe 2A or the same first forepart 7 may be removably attached to the toe region 5B of the left shoe 2B. Likewise, the second forepart 8 may be removably attached to the toe region 5A of the right shoe 2A or to the toe region 5B of the left shoe 2B. This permits a user of the kit 1 to select which of shoes 2A or 2B will receive forepart 7, and which will receive forepart 8, depending on whether the user bowls left-handed or right-handed.

When attached, the foreparts cover the entire toe region area of each shoe. This feature of the present invention is important because it prevents the peripheral shoe sole material from making contact with the bowling surface, which affects the movement of the bowler. This feature provides a consistent "feel" and consistent amount of traction to the wearer. This shoe construction allows the shoe to function as though the entire shoe sole was constructed from the material that comprises the forepart.

To provide bowlers with even greater flexibility, the bowling footwear kit may also include a first heel part 9 for removably attaching to the heel region 6B of the left shoe 2B or the heel region 6A of the right shoe 2A, and a second heel part 10 for removably attaching to the heel region 6B of the left shoe 2B or the heel region 6A of the right shoe 2A. Each heel part has a bottom surface 17 for contact with the ground and a mounting surface 18 for contact with and mounting to the heel regions 6A and 6B. Each removable heel part comprises a material having a predetermined traction characteristic. Bottom surface 17 A has a different traction characteristic than bottom surface 17B. Various material having varied traction characteristics, such as rubber and the like, are well known in the bowling shoe art and can be used in connection with the present invention.

FIG. 2 is a bottom view of the right shoe 2A and the left shoe 2B juxtaposed on top of each other. Forepart 7 and heel part 9 are shown attached to the shoe 2B, and is shown in broken lines attached to shoe 2A for comparison. As can be clearly seen in FIG. 2, although the left and right shoe are substantially asymmetric and are mirror images of each other in peripheral shape, the peripheral shapes of the toe region 5B of the left shoe 2B and of the toe region 5A of the right shoe 2A are substantially identical. Similarly, the peripheral shape of the forepart 7 is substantially identical to that of both the toe regions 5A and 5B. As described in more detail below, such construction allows for interchangeable attachment of various foreparts and heel parts to either the left or right shoe, without the need to purchase differently-shaped foreparts for each shoe.

FIGS. 3A and 3B show that the foreparts 7 and 8 and the heel parts 9 and 10 each may be used on either the right shoe 2A or the left shoe 2B. The foreparts and heel parts are shown aligned with the toe regions and heel regions of each shoe in FIGS. 3A and 3B. As can be seen in FIGS. 3A and 3B, the shapes of the heel region 6B of the left shoe 2B and the heel region 6A of the right shoe 2A are also substantially identical. This allows for the first heel part 9 to be removably attached to the heel region 6B on the left shoe 2B and also to be removably attached to the heel region 6A on the right shoe 2A. Similarly, the second heel part 10 also may be removably attached to the heel region 6B on the left shoe 2B and also may be removably attached to the toe region 6A on the right shoe 2A.

A fastening system is provided for removably securing interchangeable foreparts 7 and 8, as well as the heel parts 9 and 10 to the midsoles of the shoes. The mounting surface 13 of the foreparts 7 and 8 includes a first part 15 of the fastening system for attaching to a second part 16 of the fastening system which is disposed on the toe region 5B of the left shoe 2B and the toe region 5A of the right shoe 2A. Likewise, the mounting surface 18 of the heel parts 9 and 10 includes the first part 15 of the fastening system for attaching to the second part 16 of the fastening system which is disposed on the heel regions 6A, 6B of the left shoe 2B and the right shoe 2A respectively. The mounting surfaces 13 and 18 of the forepart and heel part are shown in FIG. 1 for illustration purposes. The fastening system can include hooks interlockingly engaging pile loops, adhesives, and other known techniques that allow for releasable attachment of a first body to a second body. For example, the hook portion may be attached to the foreparts and the heel parts, and the loop portion may be attached to the midsoles, although the opposite configuration would be equally effective. The hook portion and the loop portion may be attached to the mating faces by any suitable customary means, such as by adhesive or bonding.

In use, the foreparts 7, 8 and the heel parts 9, 10 are aligned over the toe regions 5A, 5B and the heel regions 6A, 6B respectively and the hook material 16 of the foreparts 7, 8 and the heel parts 9, 10 is firmly pressed against the loop material 15 of the toe and heel regions to secure the foreparts and heel parts in position, as shown in FIGS. 3A and 3B. When a shoe with a different traction characteristic is needed, the user simply removes one forepart or one heel part and replaces it with another forepart or heel part made with different slide material, thus giving the shoe a different traction characteristic.

The bowling footwear kit may further include a third forepart having a third traction characteristic and a fourth forepart having a fourth traction characteristic to allow for even more versatility. The third and fourth traction characteristics are different from each other and from the first and second traction characteristics of the first forepart 7 and second forepart 8 respectively. As described above with respect to the first forepart 7 and the second forepart 8, the third forepart and the fourth forepart can be removably attached to either the toe region 5A of the right shoe 2A or the toe region 5B of the left shoe 2B, and thus are interchangeable with the first and second foreparts. It should be further understood that a greater number of foreparts and heel parts, all having different traction characteristics, may be provided to accommodate a variety of lane surface conditions and bowler's individual styles.

Although the invention has been described with reference to several embodiments with certain constructions, structures, ingredients and formulations and the like, these are not intended to exhaust all possible arrangements or features, and indeed many other modifications and variations will be ascertainable to those of skill in the art

What is claimed is:

1. A footwear kit comprising:

a left shoe;

a right shoe;

wherein said left shoe and said right shoe each have a toe region;

wherein said toe region is substantially symmetric about a first center line running from a front of said toe region to a back of said toe region and substantially asymmetric about a second center line perpendicular to said first center line and running from a left to a right of said toe region;

wherein said left shoe and said right shoe each has a peripheral shape that is substantially asymmetric about a line running from a front to a back of said left shoe or said right shoe;

at least one forepart;

wherein said at least one forepart has a periphery which substantially matches a periphery of said toe region of both said left shoe and said right shoe;

wherein said toe region has a frontmost edge which is a frontmost edge of said left shoe or said right shoe;

wherein said toe region covers an entire area until at least three eighths of a distance from said frontmost edge to a backmost edge of said left shoe or said right shoe.

2. The footwear kit according to claim 1, wherein said left shoe and said right shoe each further comprises a heel region and at least one heel part.

3. The footwear kit according to claim 2, wherein said heel region of said left shoe and said heel region of said right shoe are substantially similar in that said at least one heel part can be interchangeably received by said heel region of said left shoe and said heel region said right shoe.

4. The footwear kit according to claim 3, wherein said at least one heel part has a periphery which substantially matches a periphery of said heel region of said left shoe and a periphery of said heel region of said right shoe.

5. The footwear kit according to claim 4, wherein said at least one heel part is removably attachable to said heel region of either said left shoe or said heel region of said right shoe as an outsole.

6. The footwear kit according to claim 1, wherein a periphery of said toe region of said left shoe and a periphery of said toe region of said right shoe are substantially similar.

7. The footwear kit according to claim 1, wherein said footwear kit comprises at least two foreparts and each of said at least two foreparts has a traction characteristic different from the other.

8. The footwear kit according to claim 1, wherein said at least one forepart is removably attachable to either said right shoe or said left shoe as an outsole.

9. A footwear kit comprising:

a left shoe;

a right shoe;

wherein said left shoe has a toe region and said right shoe has a toe region;

wherein said toe region of said left shoe is substantially symmetric about a first center line running from a front to a back of said toe region of said left shoe and substantially asymmetric about a second center line perpendicular to said first center line and running from a left to a right of said toe region of said left shoe;

wherein said toe region of said right shoe is substantially symmetric about a third center line running from a front to a back of said toe region of said right shoe and substantially asymmetric about a fourth center line perpendicular to said third center line and running from a left to a right of said toe region of said right shoe;

wherein said left shoe has a peripheral shape that is substantially asymmetric about a line running from a front to a back of said left shoe;

wherein said right shoe has a peripheral shape that is substantially asymmetric about a line running from a front to a back of said right shoe;

at least one forepart;

wherein said at least one forepart has a periphery which substantially matches a periphery of said toe region of said left shoe or a periphery of said toe region of said right shoe;

wherein said toe region of said left shoe has a frontmost edge which is a frontmost edge of said left shoe;

wherein said toe region of said right shoe has a frontmost edge which is a frontmost edge of said right shoe;

wherein said toe region of said left shoe covers an entire area until at least three eighths of a distance from said frontmost edge of said left shoe to a backmost edge of said left shoe;

wherein said toe region of said right shoe covers an entire area until at least three eighths of a distance from said frontmost edge of said right shoe to a backmost edge of said right shoe.

10. The footwear kit according to claim 9, wherein said left shoe further comprises a heel region and said right shoe further comprises a heel region.

11. The footwear kit according to claim 10, wherein said footwear kit further comprises at least one heel part.

12. The footwear kit according to claim 11, wherein said heel region of said left shoe and said heel region of said right shoe are substantially similar in that said at least one heel part can be interchangeably received by said heel region of said left shoe and said heel region of said right shoe.

13. The footwear kit according to claim 11, wherein said at least one heel part has a periphery which substantially matches a periphery of said heel region of said left shoe.

14. The footwear kit according to claim 11, wherein said at least one heel part has a periphery which substantially matches a periphery of said heel region of said right shoe.

15. The footwear kit according to claim 11, wherein said at least one heel part can be removably attached to said heel region of said left shoe.

16. The footwear kit according to claim 11, wherein said at least one heel part can be removably attached to said heel region of said right shoe.

17. The footwear kit according to claim 9, wherein said at least one forepart can be removably attached to said toe region of said left shoe.

18. The footwear kit according to claim 9, wherein said at least one forepart can be removably attached to said toe region of said right shoe.

19. The footwear kit according to claim 9, wherein said periphery of said toe region of said left shoe and said periphery of said toe region of said right shoe are substantially similar.

20. The footwear kit according to claim 9, wherein said footwear kit comprises at least two foreparts and each of said at least two foreparts has a traction characteristic different from the other.

* * * * *